United States Patent [19]

Jensen

[11] Patent Number: 4,524,586

[45] Date of Patent: Jun. 25, 1985

[54] CRYOGENIC REFRIGERATOR

[75] Inventor: Jack E. Jensen, Columbus, Ohio

[73] Assignee: CVI Incorporated, Hilliard, Ohio

[21] Appl. No.: 597,983

[22] Filed: Apr. 9, 1984

[51] Int. Cl.[3] ..... F25B 9/00

[52] U.S. Cl. ..... 62/6; 60/520

[58] Field of Search ..... 62/6; 60/520

[56] References Cited

U.S. PATENT DOCUMENTS 2,966,035 12/1960 Gifford ..... 62/6
3,188,818 6/1965 Hogan ..... 62/6
3,218,815 11/1965 Chellis et al. ..... 62/6
4,305,741 12/1981 Sarcia ..... 62/6
4,438,631 3/1984 Sarcia ..... 62/6

*Primary Examiner*—Ronald C. Capossela
*Attorney, Agent, or Firm*—Seidel, Gonda, Goldhammer

[57] ABSTRACT

The cryogenic refrigerator includes a movable displacer within an enclosure having first and second chambers of variable volume. A refrigerant fluid is circulated in a fluid path between said chambers and correlated with movement of the displacer. A spool valve controls introduction of high pressure fluid and low pressure fluid to said chambers in a manner so that such flow is correlated with the pressure difference across said valve.

5 Claims, 5 Drawing Figures

FIG. 2
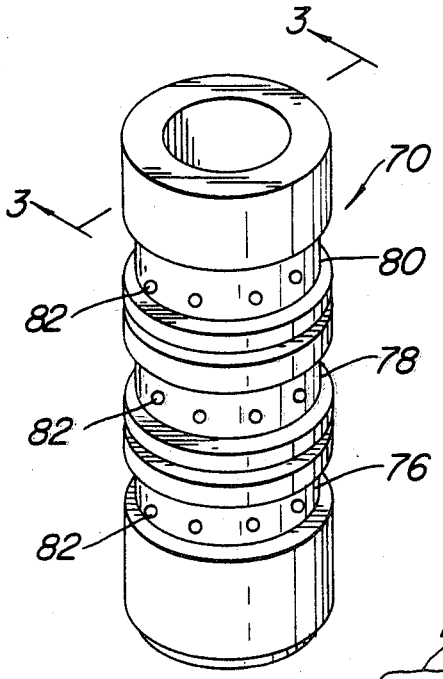
FIG. 3
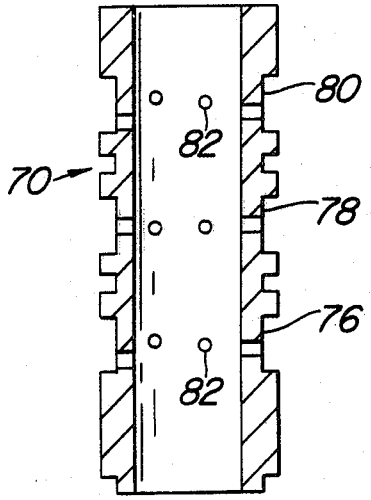
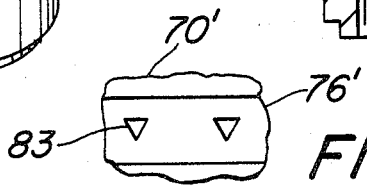
FIG. 5
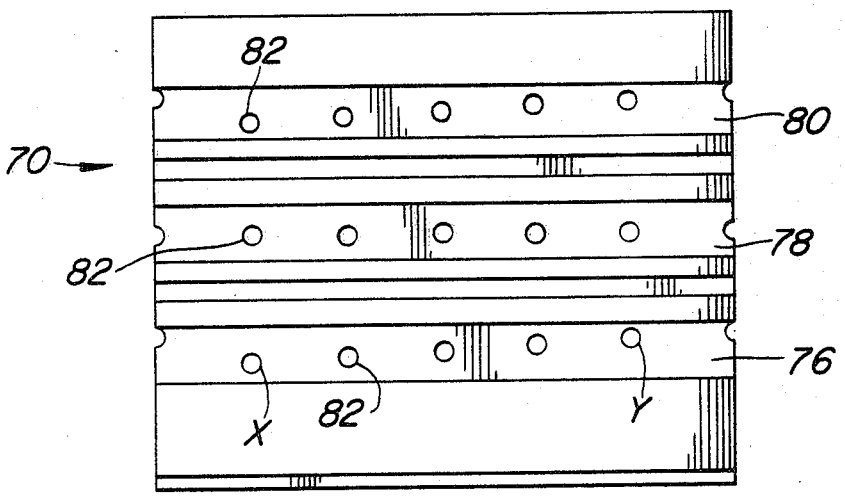
FIG. 4

CRYOGENIC REFRIGERATOR

RELATED CASE

See pending application Ser. No. 398,482 filed July 15, 1982 and entitled Cryogenic Refrigerator now U.S. Pat. No. 4,438,631.

BACKGROUND

The present invention is an improvement on the Gifford-McMahon cycle. Familiarity with said cycle is assumed. Representative prior art patents teaching such cycle include U.S. Pat. Nos. 2,966,035; 3,188,818; 3,218,815; and 4,305,741.

For maximum efficiency and reliability, it is important to have maximum gas volume transfer through the regenerator. In order that this may be attained, it is important that the direction of gas flow be reversed when the displacer is at top dead center or bottom dead center.

In the prior art, the ports or holes in the spool valve are all of the same diameter and positioned so that their centers all lie on a plane perpendicular to the center line of the sleeve bearing. That arrangement of the ports provides for a fast opening valve with very high mass flow at the start of pressurization, since the pressure difference between the high pressure and low pressure is at a maximum just before the valve opens. The high mass flow rate produces a large pressure difference across the regenerator matrix as the fluid passes through it. A large pressure drop in the regenerator manifests itself in large mechanical loads on the displacer drive system and introduces losses due to fluid friction. The dwell time of the fluid within the regenerator matrix is decreased, which can result in reducing the heat transferred between the matrix and the fluid. The present invention is directed to a solution of that problem of uneven mass flow to and from the displacer.

SUMMARY OF THE INVENTION

The present invention is directed to a cryogenic refrigerator in which a movable displacer defines within an enclosure first and second chambers of variable volume. A refrigerant fluid is circulated in a fluid flow path between the first chamber and the second chamber and correlated with movement of the displacer.

The refrigerator includes chamber means for guiding a slide connected to the displacer. A motor is connected to the slide for controlling movement of the displacer. A valve is provided with a valve member for controlling flow of the high and low pressure fluid. The valve member is reciprocated by a cam driven by said electric motor.

It is an object of the present invention to improve the efficiency of a cryogenic refrigerator and reduce flow losses in such a way that the overall efficiency is improved and the refrigeration capacity is increased.

Other objects will appear hereinafter.

For the purpose of illustrating the invention, there is provided in the drawings a form which is presently preferred; it being understood, however, that this invention is not limited to the precise arrangements and instrumentalities shown.

FIG. 2 is a perspective view of a valve sleeve bearing.

FIG. 3 is a sectional view taken along the line 3—3 in FIG. 2.

FIG. 4 is a planar projection of the periphery of the valve sleeve bearing.

FIG. 5 is a partial elevation of a groove on a modified sleeve bearing.

DETAILED DESCRIPTION

Figure 1:
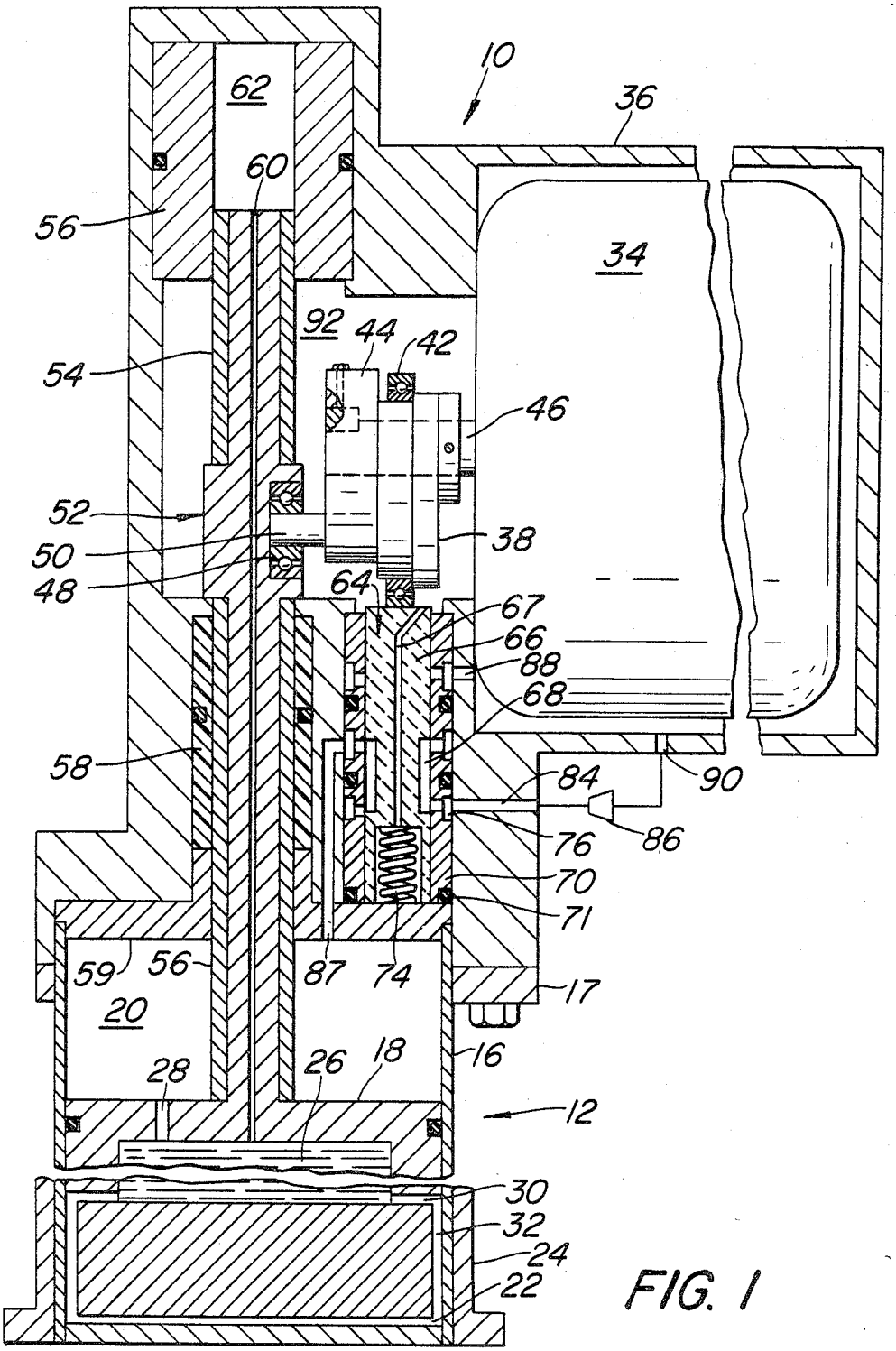
FIG. 1 is a vertical sectional view of a refrigerator in accordance with the present invention with the displacer at bottom dead center.

Referring to the drawings in detail, wherein like numerals indicate like elements, there is shown a refrigerator in accordance with the present invention designated generally as 10. As illustrated, the refrigerator 10 has a first stage 12. It is within the scope of the present invention to have one or more stages. When in use, the stages are disposed within a vacuum housing not shown. Each stage includes a housing 16 within which is provided a displacer 18. The displacer 18 has a length less than the length of the housing 16 so as to define a warm chamber 20 thereabove and a cold chamber 22 therebelow. The designations warm and cold are relative as is well known to those skilled in the art.

Within the displacer 18, there is provided a regenerator 26 containing a matrix. Ports 28 communicate the upper end of the matrix in regenerator 26 with the warm chamber 20. Radially disposed ports 30 communicate the lower end of the matrix in regenerator 26 with a clearance space 32 disposed between the outer periphery of the lower end of the displacer 18 and the inner periphery of the housing 16. Thus, the lower end of the matrix in regenerator 26 communicates with cold chamber 22 by way of ports 30 and clearance 32 which is an annular gap heat exchanger.

The matrix in regenerator 26 is preferably a stack of 250 mesh material having high specific heat such as oxygen-free copper. The matrix has low void area and low pressure drop. The matrix may be other materials such as lead spheres, nylon, glass, etc.

An electrical motor 34, such as a reversible synchronous stepper motor, is disposed within a housing 36. Housing 16 depends downwardly from and has a flange 17 bolted to housing 36. A cam 38 is connected to the output shaft 46 of motor 34. A roller bearing type follower 42 is connected to the outer periphery of cam 38. A crank arm 44 is connected to shaft 46. Crank arm 44 is connected to a roller bearing type follower 48 by shaft 50. Shafts 50 and 46 are parallel. Follower 48 is disposed within a transverse slot on slide 52. Slide 52 is connected to the upper end of the displacer 18.

The slide 52 has a cylindrical bearing insert 54 guided by clearance seal sleeve bearing 56. The slide 52 also has a cylindrical bearing insert 56 guided by clearance seal sleeve bearing 58. The bearing inserts are preferably made from a hard material such as heat treated tool steel, and the sleeve bearings from a low friction plastic compound impregnated with other materials for stabilization and reduced wear. The sleeve bearing 58 is held in place by a retainer 59 connected to the housing 36. A chamber 62 within sleeve bearing 56 communicates with the regenerator 26 by way of an axial flow passage 60 in the slide 52. Passage 60 prevent gas from being compressed within chamber 62 as the slide 52 moves upwardly. Hence, slide 52 is gas balanced when its diameter is uniform at its ends.

The housing 36 includes a bore parallel to the slide 52. Within the bore there is provided a spool valve designated generally as 64. A clearance seal sleeve bearing 70 preferably made from a fine grained metallic material is positioned in the bore. The valve 64 includes a cylindrical spool valve member 66 preferably made from a ceramic material within bearing 70. Member 66 has a groove 68 on its outer periphery between its ends and has an axially extending equalizing passage 67. A seal 71 is provided between the bearing 70 and the retainer 59. O-ring seals are preferably provided on elements 18, 58, 56, and 70 as shown in FIG. 1.

A coil spring 74 extends between retainer 59 and a recess in valve member 66 for biasing the valve member 66 into contact with follower 42 on cam 38. The valve member 66 is moved downwardly by the cam 38 and is moved upwardly by expansion of the spring 74.

Referring to FIGS. 2 and 3, the sleeve bearing 70 has axially spaced peripheral grooves 76, 78 and 80. Flow passages 82 extend radially through the wall at the bottom of the grooves. As shown in FIG. 4, the flow passages 82 in each groove have their axes on a line skewed relative to a radial line by an angle of about 3°. Hence, when one of the flow passages 82 designated X is fully open, another flow passage designated Y is just starting to open. Flow through the passages 82 between those designated X and Y are at an intermediate stage of partial flow. Passages 82 are arranged in a helical pattern on sleeve bearing 70 and preferably have a diameter between 0.031 and 0.093 inches when bearing 70 has an inner diameter of 0.5 inches. While six flow passages 82 are illustrated in each groove on sleeve bearing 70, a greater or lessor number may be utilized with an appropriate change of diameter to handle the desired flow rate.

In FIG. 5 there is shown a modified sleeve bearing 70' which is the same as bearing 70 except as follows. The passages 83 are all equidistant from the edges of groove 76' but are triangular in shape with their apices pointing downwardly.

Referring to FIG. 1, high pressure is introduced into port 84 from the outlet side of a compressor 86. Port 84 communicates with the groove 68 when the valve member 66 is in the position as shown in FIG. 1 via passages 82 in groove 76. When valve member 66 is in the position as shown in FIG. 1, groove 68 also communicates with warm chamber 20 by way of passage 87.

A passage 88 extends from the interior of housing 36 and is blocked by the valve member 66 in the position of the latter shown in FIG. 1. When the valve member 66 is in its uppermost position, the groove 68 communicates passage 87 with passage 88. The interior of the housing 36 communicates with the inlet side of compressor 86 by way of port 90. Chamber 92 is in direct communication with the interior of housing 36. The flow of a refrigerant from passage 88 to port 90 has a cooling effect on the motor 34. If desired, passage 88 may be eliminated by causing groove 68 to communicate with chamber 92 at the top dead center position of valve member 66. It will be noted that the axial length of groove 68 is less than the axial distance between port 84 and passage 88 to thereby minimize leakage of high pressure gas between said port and passage.

The housing 36 is constructed of a number of components so as to facilitate machining, assembly, access to the valve member 66 and slide 52. The manner in which the housing 36 is comprised of a plurality of components is not illustrated but will be obvious to those skilled in the art.

The refrigerator 10 is preferably designed for use with a cryogenic fluid such as helium but other fluids such as air and nitrogen may be used. The refrigerator 10 was designed to have a wattage output of at least 65 watts as 77° K. and a minimum of 5 watts at 20° K.

OPERATION

As shown in FIG. 1, the displacer 18 is at bottom dead center. Vertical reciprocation of slide 52 is controlled by the rotative position of cam 38 and the cooperation between follower 48 and the slide groove receiving the follower. The spool valve member 66 is in its lowermost position with the spring 74 compressed due to contact of member 66 with the roller bearing follower 42. High pressure fluid is introduced from port 84, through grooves 68 and 70, and passage 87 to the warm chamber 20. Passage 88 is blocked by the valve member 66.

The function of the regenerator 26 is to cool the gas passing downwardly therethrough and to heat gas passing upwardly therethrough. In passage downwardly through the regenerator, the gas is cooled thereby causing the pressure to decrease and further gas to enter the system to maintain the maximum cycle pressure. The decrease in temperature of the gas in chamber 22 is useful refrigeration which is sought to be attained by the apparatus at heat station 24. As the gas flows upwardly through the regenerator 26, it is heated by the matrix to near ambient temperature thereby cooling the matrix.

The motor 34 rotates cam 38 and the displacer 18 is moved upwardly from bottom dead center. As the cam 38 continues to rotate, the valve member 66 moves upwardly under the pressure of spring 74. Valve member 66 closes off flow from port 84 after it has moved upwardly.

As the cam 38 continues to rotate, the slide 52 and displacer 18 continue to move upwardly. As the slide 52 approaches top dead center, follower 42 permits the vave member 66 to be reciprocated sufficiently upwardly so as to cause groove 68 to communicate passages 87 and 88 and thereby commence the exhaust portion of the cycle. The passages 82 in grooves 78 and 80 are progressively opened to full flow. During this period the pressure in the displacer 18 will decrease and thus the pressure differences across the valve member 66 will be increasing thereby requiring more flow area (more passages 82 fully open) to fully exhaust the volume of displacer 18.

This technique of matching the flow area to pressure difference across the valve 64 will make it possible to approach a constant mass flow rate into or out of the displacer 18 and thereby increase the dwell time of the fluid within the regeneration matrix while reducing pressure-drop induced flow losses and shocks to the drive mechanism.

As the cam 38 continues to rotate, the valve member 66 moves downwardly and closes passage 88. As the displacer approaches bottom dead center valve member 66 is moved sufficiently downwardly so as to cause groove 68 to communicate port 84 with passage 87. The progressive change in the flow rate is similar to that set forth above. During the opening period the pressure in displacer 18 will be increasing and the pressure difference across valve 64 will be decreasing, thereby requiring more flow area to fill the displacer volume.

A typical embodiment operates at the rate of 72 to 80 cycles per minute. The reciprocatory movement of the displacer 18 and valve member 66 is synchronized to occur simultaneously in the same direction with the stroke of displacer 18 being greater than the stroke of valve member 66. Timing is predetermined by cam 38 so that valve member 66 and displacer 18 reciprocate at different rates. The length of stroke of the valve member 66 is short such as 9 to 12 mm and is 30 mm for the displacer 18. Valve member 66 has axial flow passage 67 communicating the low pressure of chamber 92 to the chamber containing spring chamber.

The refrigeration available at heat station 24 may be used in connection with a wide variety of devices. One such device is a cryopump. The structural interrelationship disclosed results in positive control over the simultaneous movements of the slide 52 and valve member 66 so that introduction of high pressure gas and exhausting of low pressure gas is synchronized in a positive manner. Because high and low pressure gas is introduced or exhausted at the exact position of bottom dead center and top dead center for the slide 52, efficiency is increased with assurance of a complete introduction or exhaustion of a charge of gas.

The present invention may be embodied in other specific forms without departing from the spirit of essential attributes thereof and, accordingly, reference should be made to the appended claims, rather than to the foregoing specification, as indicating the scope of the invention.

I claim:

1. In a cryogenic refrigerator in which a movable displacer means defines within an enclosure first and second chambers of variable volume, and in which a refrigerant fluid is circulated in a fluid path between the first chamber and the second chamber by movement of the displacer means, chamber means for guiding a slide connected to the displacer means, a motor connected to said slide for reciprocating said slide, a valve having a reciprocable valve member for controlling the flow of high and low pressure fluid, said valve member having a peripheral groove, said motor being arranged to move said valve member in timed relation with movement of said slide so that the valve member will introduce high pressure fluid via said groove into said first and second chambers when the displacer means is at one of the extremities of its movement, and means for controlling said flow so that the flow from the groove to or from the displacer is correlated with the pressure difference across said valve.

2. In a refrigerator in accordance with claim 1 wherein said last mentioned means includes a cylindrical sleeve within which said valve member reciprocates, two spaced rows of flow passages in said sleeve, said groove communicating with only one of said rows at any time, said rows of passages being helical with respect to said sleeve axis.

3. In a refrigerator in accordance with claim 1 wherein said last mentioned means includes a cylindrical sleeve around said valve member, said sleeve having a row of triangular shaped flow passages uncovered by said valve member as it reciprocates.

4. In a cryogenic refrigerator in which a movable displacer means defines within an enclosure first and second chambers of variable volume, and in which a refrigerant fluid is circulated in a fluid path between the first chamber and the second chamber by movement of the displacer means, a regenerator associated with said displacer means, chamber means for guiding a slide connected to the displacer means, a motor connected to said slide for reciprocating said slide, a valve having a reciprocable valve member for controlling the flow of high and low pressure fluid, said valve member having a peripheral groove, said motor being arranged to move said valve member in timed relation with movement of said slide so that the valve member will introduce high pressure fluid via said groove into said first and second chambers when the displacer means is at one of the extremities of its movement, and means for controlling said flow so that the flow from the groove to or from the displacer is at a substantially constant mass flow rate to thereby increase the dwell time of the fluid within said regenerator.

5. In a refrigerator in accordance with claim 4 wherein said last mentioned means includes a cylindrical sleeve within which said valve member reciprocates, two spaced rows of flow passages in said sleeve, said groove communicating with only one of said rows at any time, said rows of passages being helical with respect to said sleeve axis.

* * * * *